US006604461B1

(12) United States Patent
De Bock et al.

(10) Patent No.: US 6,604,461 B1
(45) Date of Patent: Aug. 12, 2003

(54) PRINTER AND METHOD OF PRINTING

(75) Inventors: Jan De Bock, Melsele (BE); Wim Michielsen, Wommelgem (BE); Daniel Van de Velde, Kontich (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 09/684,592

(22) Filed: Oct. 5, 2000

(30) Foreign Application Priority Data

Oct. 6, 1999 (GB) ..... 9923496

(51) Int. Cl.[7] ..... B41M 1/14; G03G 15/16

(52) U.S. Cl. ..... 101/211; 399/302; 399/307

(58) Field of Search ..... 101/211, 487, 101/488, 489–490; 399/162, 167, 302, 307, 308, 324, 328

(56) References Cited

U.S. PATENT DOCUMENTS 4,541,709 A * 9/1985 Kampschreur ..... 399/162
4,708,460 A * 11/1987 Langdon ..... 399/308
5,410,392 A 4/1995 Landa
5,519,476 A * 5/1996 Dalal et al. ..... 399/307
5,561,510 A 10/1996 Kamp et al.
5,612,773 A * 3/1997 Berkes et al. ..... 399/307
5,629,761 A * 5/1997 Theodoulou et al. ..... 399/307
5,805,967 A 9/1998 De Bock et al.
5,832,352 A * 11/1998 Pan et al. ..... 399/307
5,893,018 A 4/1999 De Bock et al.
6,088,565 A 6/2000 Jia et al.
6,141,524 A * 10/2000 Berkes et al. ..... 399/307

FOREIGN PATENT DOCUMENTS

DE G 93 20 251 2 4/1994
EP 0 871 082 A1 10/1998

* cited by examiner

*Primary Examiner*—Eugene H. Eickholt
(74) *Attorney, Agent, or Firm*—Knobbe Martens Olson & Bear LLP

(57) ABSTRACT

The printer comprises image-forming stations at which developed toner images are formed and electrostatically transferred in register to an endless primary belt. A heat transfer minimizing nip contact is formed between the primary belt and an intermediate belt. The intermediate belt is heated downstream of the nip to heat the image thereon and to transfer the image from the intermediate belt to a substrate.

18 Claims, 3 Drawing Sheets

PRINTER AND METHOD OF PRINTING

BACKGROUND OF THE INVENTION

1. Field of the Invention

The present invention relates to a multi-color printer and to a method of printing, in particular to a single-pass multi-color printer and to a method of printing multi-color developed toner images on a substrate.

2. Description of the Related Art

To enable printing on a wide variety of recording media, at least one transfer member has to be introduced to transfer a developed toner image from an image-forming station via this transfer member to a recording medium (substrate) where it can be fused. It is a clear benefit that the use of such a transfer member obviates the need for the conditioning of the substrate or at least the conditioning is less demanding.

When a single transfer member is used, it is in direct contact with an image-forming member, which is for example a photoconductive belt or drum, at each image-forming station to receive the image therefrom. As a consequence, the temperature at each contact should be low, preferably below the glass transition temperature of the toner. A higher temperature can lead to (permanent) contamination of the image-forming member which negatively influences the quality of the toner image formed on the image-forming member. However, the transfer and simultaneous fusing ("transfuse") of the toner image to the substrate requires both heat and pressure. The exact temperature of the transfer or transfuse depends on the nature of the transfer member as well as that of the substrate. The temperature has to be close to the softening temperature of the toner in order to guarantee a good transfer. This is typically in the range from 90 to 150° C. Therefore, heating means have to be provided to heat at least the portion of the transfer member at the nip between the transfer member and the substrate. Subsequent cooling of the transfer member is required to ensure that the temperature of at least the portion of the transfer member contacting the image-forming members is sufficiently low. To produce such a large temperature change, active cooling means and heating means have to be provided in close proximity to each other. This negatively influences the power consumption, even when making use of some heat exchange. It is clear that all these requirements are difficult to meet simultaneously using a single transfer member, while ensuring a high quality, high resolution single-pass multi-color print.

A high printing speed and multi-color printing facilities are basic requirements for leading edge copy and printing machines, resulting in even more stringent requirements for the transfer processes and the nature of the transfer members. The speed requirements impose a single-pass configuration. In such a configuration, a multiple toner image is formed on the transfer member by electrostatically transferring a plurality of developed toner images in register with each other from a plurality of image-forming stations during a single revolution of the transfer member. The resulting charged multiple toner image is far more difficult to transfer than a single toner image.

In U.S. Pat. No. 5,805,967 (De Bock et al./Xeikon NV), a multi-color single-pass printer is described. The printer includes a plurality of image-forming stations at which developed toner images are formed. Each of these images is electrostatically transferred to an endless primary belt. An isothermal intermediate transfer zone is established by the face-to-face contact between the primary belt and an endless intermediate belt. The intermediate belt is heated downstream of the intermediate transfer zone to heat the image thereon. A final transfer station transfers the heated image from the intermediate belt to a substrate. The intermediate belt is then forcibly cooled before returning to contact the primary belt in the intermediate transfer zone.

In a modification of this printer, shown in FIGS. 16 and 17 of U.S. Pat. No. 5,893,018 (De Bock et al./Xeikon NV), the intermediate transfer zone is formed between first and second guide rollers pressed towards each other to cause extended contact between the primary belt and the intermediate belt. The first guide roller is electrically biased to create an electrical field in the intermediate transfer zone to assist in transferring the image from the primary belt to the intermediate belt. While the extended contact zone enables the transfer of drive from the intermediate transfer belt to the primary belt, it would also result in an excessive transfer of heat to the primary belt, unless the intermediate transfer belt is cooled after transfer of the image to the substrate and before its return to the intermediate transfer zone. Furthermore, the extended contact zone can result in a distortion of the transferred images.

While such a method is capable of producing good quality results, the need to both heat and cool the intermediate belt consumes significant amounts of energy and puts limiting restrictions upon the characteristics of the intermediate belt and its support mechanism.

It is an aim of the invention to provide a single-pass multi-color printer which allows for printing on a wide variety of recording media by making use of two transfer belts between the image-forming members and the substrate. To limit power consumption, for economical reasons as well as for reasons of reliability, simultaneous heating and cooling of the same transfer belt has to be avoided. It is a further aim of the invention to improve the transfer efficiency of the toner image from the image-forming members to the substrate, particularly the transfer from the primary transfer belt to the intermediate transfer belt.

SUMMARY OF THE INVENTION

In one embodiment of the invention, the printer comprises a primary image transfer belt receiving a toner image from one or more image transfer stations, an intermediate image transfer belt in nip contact with the primary image transfer belt for image transfer from the primary image transfer belt to the intermediate image transfer belt, and a final transfer station to transfer the toner image from the intermediate image transfer belt to a substrate. In some advantageous embodiments of the invention, the intermediate image transfer belt receives no active cooling.

In another embodiment, the invention comprises a method of printing a single-pass multi-color image comprising forming a toner image on a primary image transfer belt, transferring the toner image from the primary image transfer belt to an intermediate image transfer belt through a nip contact between the primary image transfer belt and the intermediate image transfer belt, and transferring the toner image from the intermediate image transfer belt to a substrate.

Furthermore, a method of minimizing heat transfer between a primary image transfer belt and an intermediate image transfer belt may comprise forming a nip contact between the image transfer belts such that image transfer is accomplished across a temperature gradient without excessive heat transfer from the intermediate transfer belt to the primary image transfer belt.

DETAILED DESCRIPTION OF THE PREFERRED EMBODIMENTS

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
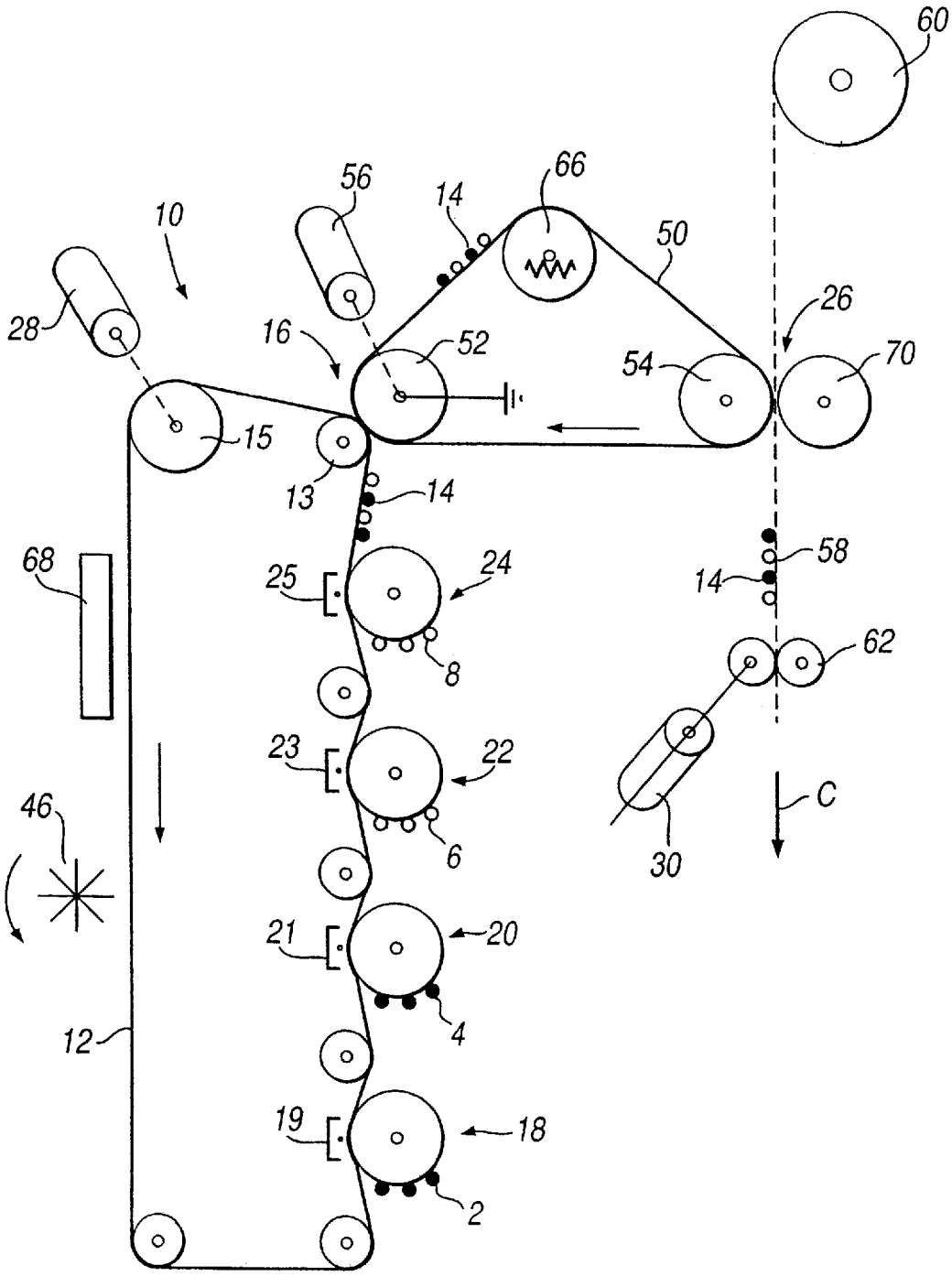
FIG. 1 is a schematic illustration of a printer according to the invention.

FIG. 1 illustrates one embodiment of a printer 10 according to the invention. The printer 10 includes a primary transfer belt 12 in contact with an intermediate transfer belt 50 at a transfer station 16. Downstream of transfer station 16, the intermediate transfer belt 50 contacts a substrate 58 at a transfer station 26, thereby depositing a toner image 14 thereon.

In one embodiment of the invention, a plurality of toner image-forming stations 18, 20, 22, 24 are spaced along one run of the primary transfer belt 12. The image-forming stations 18, 20, 22, 24 may take the form as described in the above mentioned U.S. Pat. No. 5,805,967 (incorporated herein by reference). In another embodiment, each of the image-forming stations 18, 20, 22, 24 is similar to those described in U.S. Pat. No. 5,893,018, and include a corona discharge unit 19, 21, 23, 25, to electrostatically deposit a toner image 2, 4, 6, 8 onto the primary transfer belt 12.

Because the primary transfer belt 12 contacts the image-forming member, e.g. a photoconductive drum or belt, of each image-forming station 18, 20, 22, 24 the temperature of the primary transfer belt 12 should be below the glass transition temperature of the toner, at least at the contact region. Preferably the primary transfer belt 12 is composed of a semi-insulating or insulating material with a low surface energy or comprises at least a top coating layer of such a material. A semi-insulating material is a material with a resistance in the range from 1E7 to 1E9 ($1\times10^7$ to $1\times10^9$) ohm cm. More preferably, this material is selected from a polyester such as Hytrel 7246, a polyamide such as Nylon 6 or a dissipative polymer blend. The primary transfer belt 12 may consist entirely of this material, or be in the form of a base material coated with such an electrically semi-insulating material. The base material of the primary transfer belt 12 may be a metal, such as stainless steel, a polyimide, a polyvinyl fluoride, a polyester, and mixtures thereof. Polyester has the advantage of good mechanical and electrical characteristics and of being less sensitive to humidity. In one embodiment of the invention, the primary transfer belt 12 is formed of polyethylene terephthalate (PET) having a thickness of 100 $\mu$m.

In one embodiment, each of the plurality of developed toner images 2, 4, 6, 8, is deposited by electrostatics onto the primary transfer belt 12. The electrostatic process can be accomplished by giving an electrostatic charge to a photosensitive surface of an image-forming member, such as the surface of a rotating drum, located at each image forming station 18, 20, 22, 24, and the charged surface is image-wise exposed to form a charged latent image which is then developed with particulate toner. The so-formed developed toner image is then electrostatically transferred from the drum surface to the primary transfer belt 12. The operation of the image-forming stations 18, 20, 22, 24 is controlled in such a manner as to ensure that the plurality of developed toner images 2, 4, 6, 8 are deposited on the primary transfer belt 12 in register with each other.

Still referring to FIG. 1, downstream of the image forming stations 18, 20, 22, 24, the primary transfer belt 12 contacts the intermediate transfer belt 50 at the transfer station 16. In one embodiment, the primary transfer belt 12 passes over a number of guide rollers, including a nip-forming guide roller 13 and a drive roller 15 driven by a motor 28. In another embodiment, the primary transfer belt 12 is continuously driven in turn through the image-forming stations 18, 20, 22, 24, through the intermediate transfer nip 16, through a cooling station 68 and through a cleaning station 46.

A cooling device 68 may be provided to cool the primary transfer belt 12 downstream of the intermediate transfer nip 16 to assist in establishing the temperature gradient at the intermediate transfer nip 16. The primary transfer belt 12 may be forcibly cooled by contact with a cooled body and/or by directing a cooled medium onto the primary transfer belt 12. A primary transfer belt 12 may be used having a small heat capacitance, which may be particularly advantageous in the case where no forced cooling is applied to the primary transfer belt 12. Ideally, the primary transfer belt 12 is at a temperature below the glass transition temperature of the toner, which is typically about 55° C. or below, before the deposition of further developed toner images 2, 4, 6, 8. This enables the intermediate transfer belt 50 to maintain a more constant temperature, which results in a significant saving in energy consumption and enhances the stability of the printing process.

A cleaning device 46 may be provided for cleaning the primary transfer belt 12, preferably located downstream of the cooling device 68. The cleaning device 46 may be, for example, in the form of a counter-rotating cleaning brush with vacuum pick-up. This cleaning removes any last traces of residual toner, substrate fibers and other contaminants from the primary transfer belt 12. By cleaning the primary transfer belt 12 after the cooling thereof, it is ensured that any residual toner is in a non-tacky state and thereby more easily removed.

Downstream of transfer station 16, the intermediate transfer belt 50 further contacts the substrate at transfer station 26. This final transfer station 26 comprises a nip formed between a guide roller 54 of the intermediate transfer belt 50 and a counter roller 70, through which nip the intermediate transfer belt 50 and the substrate 58 in the form of a media web pass in intimate contact with each other. Drive rollers 62, driven by a motor 30, drive the substrate or web 58 in the direction of the arrow C from a supply roll 60 continuously through the final transfer station 26 where it is pressed against the intermediate transfer belt 50 by the counter roller 70.

This transfer/transfuse of the toner image 14 from the intermediate transfer belt 50 to the substrate 58 is achieved by means of pressure and heat. To facilitate the transfer the conditions have to be such that the surface of the intermediate transfer belt 50 facing the substrate 58 has a surface energy lower than the surface energy of the surface of the substrate 58 facing the intermediate transfer belt 50. Therefore, the top coating layer of the intermediate transfer belt 50 is selected to have excellent release properties. Moreover, preferably the intermediate transfer belt 50, at least the portion in contact with the substrate 58, is at a temperature higher than the temperature of the substrate 58 in the contact area as this increases the gradient in surface energy. The temperature of the intermediate transfer belt 50 at the contact area with the substrate 58 is preferably close to the softening temperature of the toner in order to guarantee a good transfer. The temperature is typically in the range from 90 to 150° C. One can opt for a simultaneous transfer and fusing of the toner image 14 or execute the fusing later on the substrate 58, e.g. using a source of heat radiation. The first option is the preferred one especially when taking the process complexity and power consumption into account.

The intermediate transfer belt 50 therefore preferably comprises an electrically conductive backing having a surface covering formed of a relatively low surface energy material, relative to the surface of the primary transfer belt 12 and of the substrate 58. The intermediate transfer belt 50 may comprise an outer surface formed of, for example silicone elastomer (surface energy typically 20 dyne/cm), polytetrafluoroethylene, polyfluoralkylene, fluorosilicones and other fluorinated polymers.

In one embodiment, the intermediate transfer belt 50 is formed with an electrically conductive metal backing 51 having a thickness of between 50 and 150 $\mu$m, such as 75 $\mu$m stainless steel or 100 $\mu$m nickel. The backing has a 40 $\mu$m surface covering 53 formed of silicone elastomer which has a low surface energy material, relative to the surface of the primary transfer belt 12 and of the substrate 58.

The printer 10 may further comprise a heating device 66 for the intermediate transfer belt 50. The heating device 66 may be in the form of a an infra-red radiant heater, although other forms of heating including HF radiation, induction heating, convection heating and conduction heating, for example the use of heated rollers, are also suitable. The temperature to which the multi-color image 14 on the intermediate transfer belt 50 is heated is important. In particular, the surface of the toner image 14 should contact the substrate 58 at a predetermined temperature, so as to ensure mixing of the toner particles of different colors, complete transfer of the mixed multiple toner image 14 to the substrate 58 and the fixing of the image on the substrate 58. This temperature is at least 80° C.

Besides the first cold electrostatic transfer from the image-forming stations 18, 20, 22, 24, to the primary transfer belt 12 and the final hot transfer from the intermediate transfer belt 50 to the substrate 58, both being capable of separate optimization, there is also the intermediate transfer from the primary transfer belt 12 to the intermediate transfer belt 50. This intermediate transfer can be the most difficult to optimize because many process parameters are already imposed by the first and/or final transfer.

The prior art solutions are in favor of an isothermal transfer, which means that the temperatures of the primary transfer belt 12 and the intermediate transfer belt 50 are substantially identical in the intermediate transfer contact area. A cold to hot transfer from a surface with a high surface energy to a surface with a low surface energy has previously been believed impossible, or is at least thought to lead to a poor transfer. Nevertheless, the configuration and method of the present invention surprisingly succeeds in establishing an excellent transfer by using the temperature difference between the primary transfer belt 12 and the intermediate transfer belt 50 at the intermediate transfer contact region to its advantage, while avoiding back transfer of residues of the toner images and at least limiting local warming up of the primary transfer belt 12.

Referring back to FIG. 1, the intermediate transfer nip 16 is formed between the guide roller 13 and a second guide roller 52, through which nip the primary transfer belt 12 and an intermediate transfer belt 50 pass in intimate contact with each other.

The intermediate transfer belt 50 is driven by a motor 56 continuously in turn through the intermediate transfer nip 16, over a heated roller 66 through the final transfer station 26. The heated roller 66 is positioned after the intermediate transfer nip 16 and before the second transfer station 26.

A temperature gradient is established at the intermediate transfer nip 16 between the relatively cold primary transfer belt 12 and the relatively hot intermediate transfer belt 50. This temperature gradient can conveniently be described in terms of the temperature difference between the two belts immediately upstream of the nip. The temperature of the intermediate transfer belt 50 immediately upstream of the intermediate transfer nip 16 is preferably at least 30 Centigrade degrees higher than the temperature of the primary transfer belt 12 immediately upstream of the intermediate transfer nip 16.

The intermediate transfer nip 16 is defined by the two guide rollers 13, 52 being pressed against each other while the transfer belts are fed between them. The characteristics of the nip are determined by the relative pressure exerted on both guide rollers 13, 52 as well as their shape, dimensions and composition. The pressure exerted between the first guide roller 13 and the second guide roller 52 at the intermediate transfer nip 16 may be between 20 N and 400 N. To adjust this pressure, one or both of the guide rollers 13, 52 at the intermediate transfer nip 16 may be movably mounted, to enable the rollers 13, 52 to be adjusted towards or away from each other.

At the intermediate transfer nip 16, there is tangential contact between the primary transfer belt 12 and the intermediate transfer belt 50. By "tangential contact" is meant the absence of a reverse curve in the path of either belt at the nip, discounting any deformation of the guide rollers 13, 52. This is in contrast to the embodiment shown in FIG. 17 of U.S. Pat. No. 5,893,018, where the contact between a primary belt and an intermediate transfer belt involves reverse curves in the paths of both belts, leading to an extended face-to-face zone of contact between the belts.

Figure 2:
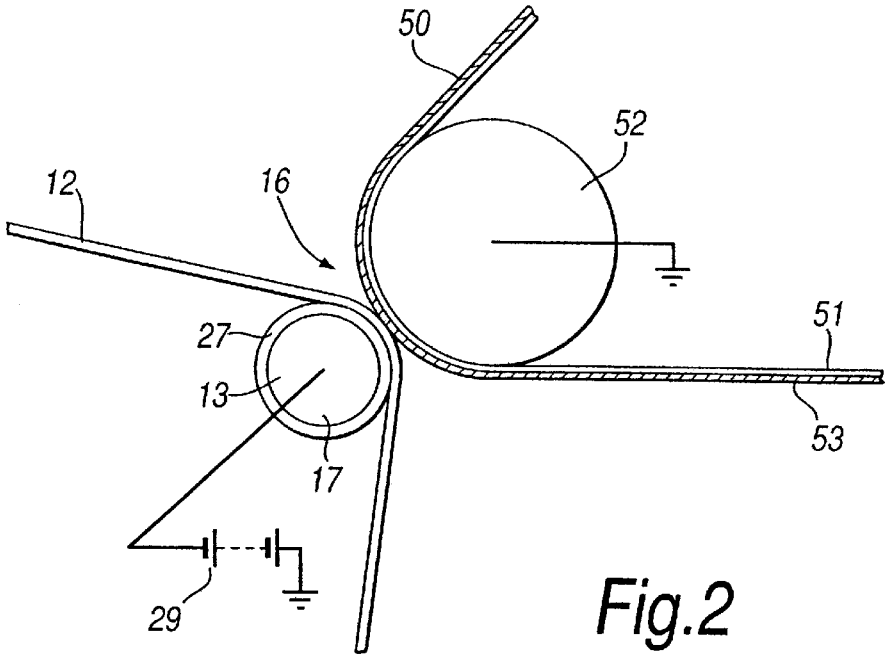
FIG. 2 is an enlarged cross-sectional view of the nip contact between belts of FIG. 1.
Figure 2A:
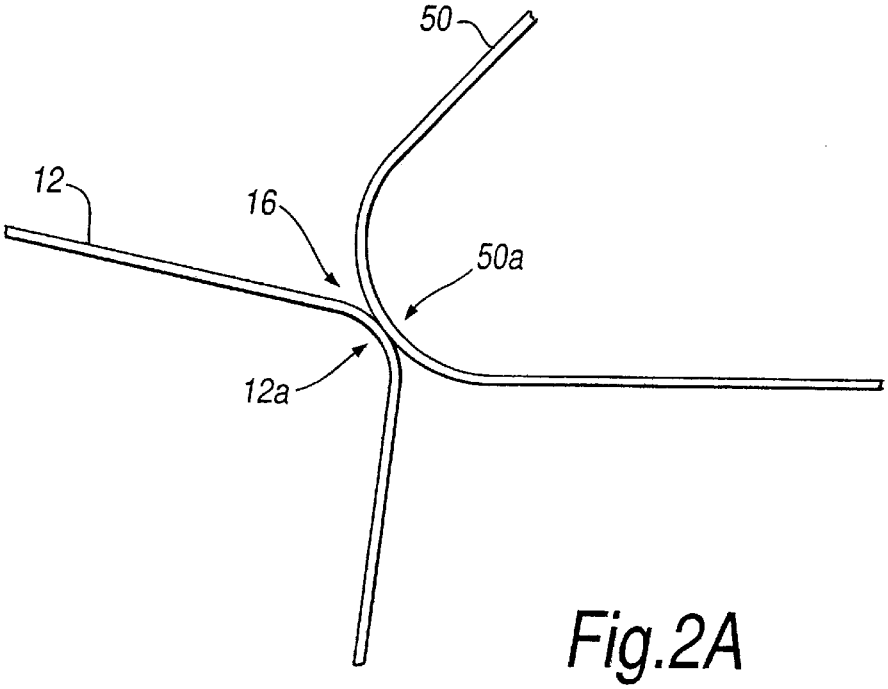
FIG. 2A is an enlarged view of the nip contact of FIG. 1, but with the guide rollers removed from the view.
Figure 3:
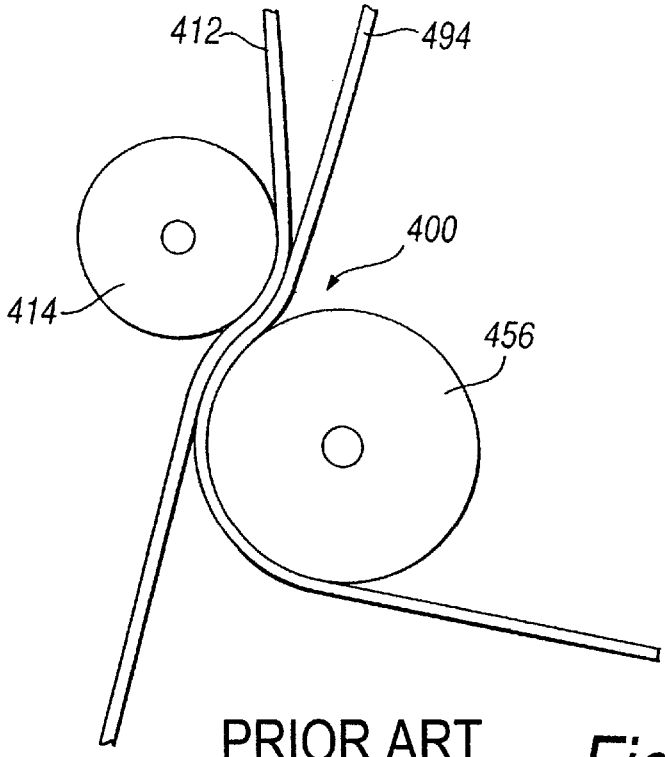
PRIOR ART Fig.3
FIG. 3 is an enlarged cross-sectional view of the belt contact in the prior art.
Figure 3A:
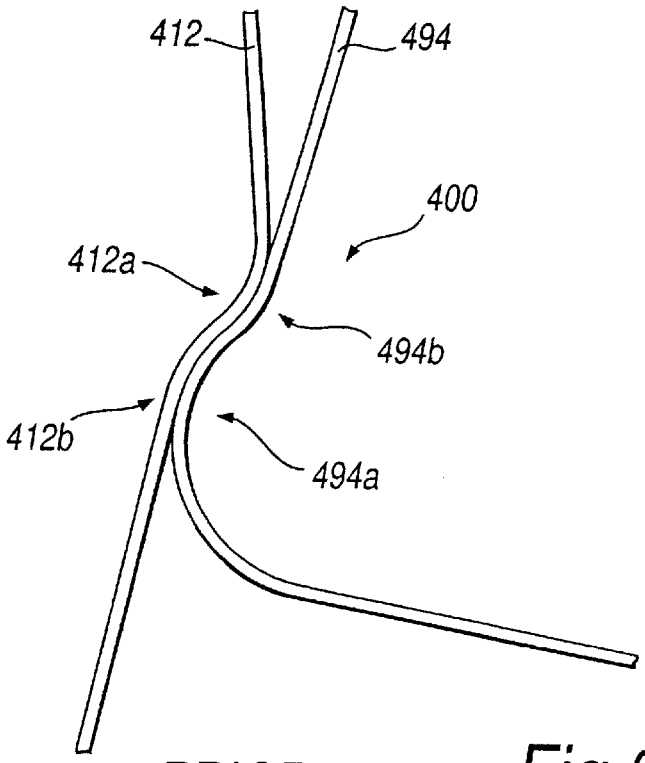
PRIOR ART Fig.3A
FIG. 3A is an enlarged cross-sectional view of the belt contact in the prior art with the guide rollers removed from the view.

As seen more clearly in FIG. 2, the intermediate transfer nip 16 is formed between the guide roller 13 and an opposing guide roller 52 pressed towards each other to cause tangential contact between said primary transfer belt 12 and an intermediate transfer belt 50. As is apparent from FIG. 2A, in which only the paths of the primary transfer belt 12 and the intermediate transfer belt 50 are shown, both belt paths follow positive curves 12*a* and 50*a* at the nip, discounting any deformation of the guide rollers. In contrast, FIGS. 3 and 3A show the part of the printer described in U.S. Pat. No. 5,893,018. In this case, an intermediate transfer zone 400 is formed between the guide roller 414 and an opposing guide roller 456 pressed towards each other to cause face-to-face contact between the primary transfer belt 412 and an intermediate transfer belt 494. As is apparent from FIG. 3A, in which only the paths of the primary transfer belt 412 and the intermediate transfer belt 494 are shown, both belt paths follow not only positive curves 412*a* and 494*a*, but also reverse curves 412*b* and 494*b*, even when discounting any deformation of the guide rollers. This results in the face-to-face configuration in FIGS. 3 and 3A, necessary to enable drive from the intermediate transfer belt 494 to be transmitted to the primary transfer belt 412, whereas the absence of such reverse curves in the embodiment of the invention shown in FIGS. 2 and 2A results in a tangential contact across which substantially no drive and no heat is transmitted.

As a result of the use of an intermediate transfer nip 16 rather than an intermediate transfer contact zone, where there is significant face-to-face contact between the belts, as described in the prior art, the transfer of heat from the relatively hot intermediate transfer belt 50 to the relatively cold primary transfer belt 12 is small. As a consequence, the temperature of the intermediate transfer belt 50 falls only slightly as it passes through the nip 16. Relatively little heat energy need therefore be applied by the heating device 66 to the intermediate transfer belt 50 to bring the temperature of the multiple toner image 14 carried thereon to the level required for transfer to the substrate 58. We prefer that the temperature of the intermediate transfer belt 50 immediately upstream of the heating device 66 is preferably no more than 30 Centigrade degrees lower than the temperature of the intermediate transfer belt 50 immediately downstream of the heating device 66. Otherwise, an extra heating device can be added at a different position along the intermediate transfer belt 50.

Referring again to FIG. 2, the biased first guide roller 13 preferably comprises an electrically conductive core carrying a semi-insulating covering. The core may be formed of a metal such as aluminum, copper, or steel and the semi-insulating cover may be formed of a silicone rubber. Preferably the first guide roller 13 is a cylindrical roller. The second guide roller 52 is a roller comprising at least a conductive core, formed for example of aluminum.

In a first configuration, an electrical field is created between the two biased guide rollers 13, 52, for the transfer of the multiple toner image 14 from the primary transfer belt 12 to the intermediate transfer belt 50. Preferably a highly negative voltage is applied on the conductive core of the first guide roller 13, while the second guide roller 52 is grounded. The value of this negative voltage, applied to the conductive core of the first guide roller 13, strongly depends on the thickness of the semi-insulating or insulating coating surrounding this core. Absolute values are typically in the range from 500 V to 5 kV dependant on the material properties of the coating, and the properties and thickness of the belts. Alternatively, other voltages may be applied to both the first and second guide rollers 13, 52 provided that these voltages are chosen such that the resulting electrical field has a polarity which attracts the charged toner particles towards the intermediate transfer member 50.

In a second configuration, an electrical field is created between the biased first guide roller 13 contacting the back of the primary transfer belt 12 and a conductive base of the intermediate transfer belt 50, while the second guide roller 52 contacts the back of the intermediate transfer belt 50. In the latter case, the intermediate transfer belt 50 is at least composed of an electrical conductive base layer with a dielectric layer thereon. More particularly a voltage is applied on the first biased guide roller 13, while the conductive base layer of the intermediate transfer belt 50 is grounded. Alternatively, other voltages may be applied to both the first guide roller 13 and the conductive base layer provided that these voltages are chosen such that the resulting electrical field has a polarity which attracts the charged toner particles towards the intermediate transfer member 50.

Furthermore, regardless of the precise configuration, a pre-charging device may be added to pre-charge the intermediate transfer belt 50 upstream of the intermediate transfer nip 16. Examples of such a pre-charging device are a corona or a corotron or an electrically biased brush which contacts the outer surface of the intermediate transfer member 50. When a pre-charging device is used, the absolute value of the voltage on the first biased guide roller 13 may be reduced. While the transfer efficiency is maintained or even improved, the lifetime of the intermediate transfer belt 50 can be extended.

The substrate 58 can be in the form of a web. Web cutting means, optionally together with a sheet-stacking device may be provided downstream of the intermediate transfer belt 50. Alternatively, the web is not cut into sheets, but wound onto a take-up roller. The web of substrate 58 may be fed through the printer 10 from a roll. If desired, the substrate 58 may be conditioned (i.e. its moisture content adjusted to an optimum level for printing), prior to entering the printer 10. The substrate 58 may alternatively be in the form of cut sheets, or other articles of suitable shape. Typical examples of substrate materials are paper, films, label stock and cardboard.

To transfer the multiple toner image 14 to the substrate 58, the substrate 58 may be pressed against the intermediate transfer belt 50 at the final transfer station 26, for example by use of a counter roller 70. A third drive device 30 may be provided to drive the substrate 58 into contact with the intermediate transfer belt 50 at the final transfer nip 26.

In operation, a plurality of developed toner images 2, 4, 6, 8 are electrostatically deposited in register with each other onto the primary transfer belt 12 at the image-forming stations 18, 20, 22, 24 to form a multiple toner image 14 on the primary transfer belt 12.

The primary transfer belt 12 carrying the multiple toner image 14 contacts the heated intermediate transfer belt 50 at the intermediate transfer nip 16 to electrostatically transfer the multiple toner image 14 to the intermediate transfer belt 50. The pressure exerted between the first guide roller 13 and the second guide roller 52 at the intermediate transfer nip 16 is about 100 N.

The intermediate transfer belt 50, with the multiple toner image carried thereon, is heated by heated roller 66 to a temperature of between 80° and 150° C., such as about 115° C., thereby to render the multiple toner image tacky.

The intermediate transfer belt 50 carrying the tacky multiple toner image 14 then contacts the web 58 at the final transfer station 26 to transfer the multiple toner image 14 thereto.

The intermediate transfer belt 50 is then brought into further contact with the primary transfer belt 12 while the metal belt 50 is at an elevated temperature to establish a temperature gradient at said intermediate transfer nip 16. The temperature of the intermediate transfer belt 50 immediately upstream of said intermediate transfer nip 16 is greater than 50° C., such as about 105° C., that is some 70 Centigrade degrees higher than the temperature of the primary belt 12 immediately upstream of said intermediate transfer nip 16, which is between 20° and 50° C., such as about 35° C. The temperature of the intermediate transfer belt 50 falls only slightly as the belt passes through the nip, with the result that immediately upstream of the heating device 66 the temperature is about 100° C. That is the heating device 66 need only raise the temperature of the intermediate transfer belt by about 15 Centigrade degrees to bring the toner image thereon to the required temperature for final transfer.

The primary transfer belt 12 is forcibly cooled at the cooling station 68 by directing cooled air onto the primary transfer belt 12. The primary transfer belt 12 is thereby cooled to the temperature of about 35° C. This cooling assists in establishing the required temperature gradient at the intermediate transfer nip 16. In addition, the primary transfer belt 12 is cleaned at cleaning station 46 before the deposition of further developed toner images 2, 4, 6, 8.

While the printer is described above as being constructed to transfer images onto one face of the substrate (i.e. a simplex configuration), a similar construction can additionally be provided to transfer images onto the opposite face of the substrate (i.e. a duplex configuration). The printer according to the invention may also be part of an electrostatic copier, working on similar principles to those described above in connection with electrostatic printers.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A multi-color printer comprising:

a primary image transfer belt receiving images from a plurality of image transfer stations to form a toner image thereon;

an intermediate image transfer belt in nip contact with said primary image transfer belt for image transfer from said primary image transfer belt to said intermediate image transfer belt;

a cooler positioned to cool said primary image transfer belt downstream of said nip contact;

a heater for heating said intermediate image transfer belt downstream of said nip contact with said primary image transfer belt; and a final transfer station to transfer said toner image from said intermediate image transfer belt to a substrate.

2. A printer according to claim 1, wherein said nip contact is formed between first and second guide rollers pressed towards each other to cause tangential contact between said primary image transfer belt and said intermediate image transfer belt.

3. A printer according to claim 2, further comprising a high voltage power supply forming an electric field at said nip contact to assist in transferring said toner image from said primary image transfer belt to said intermediate image transfer belt.

4. A printer according to claim 1, additionally comprising first and second drive motors, wherein said first drive motor drives said primary image transfer belt, and wherein said second drive motor drives said intermediate image transfer belt.

5. A printer according to claim 1, whereby said intermediate image transfer belt receives no active cooling.

6. A printer according to claim 1, whereby said intermediate image transfer belt receives no active cooling.

7. A printer according to claim 1, wherein said one or more image transfer stations comprise one or more electrostatic transfer devices to transfer said toner image to said primary image transfer belt.

8. A printer according to claim 1, wherein a temperature gradient is established at said nip contact.

9. A multi-color printer comprising:

a primary image transfer belt receiving a toner image from one or more image transfer stations;

an intermediate image transfer belt that receives no active cooling in contact with said primary image transfer belt for image transfer from said primary image transfer belt to said intermediate image transfer belt;

a cooler positioned to cool said primary image transfer belt downstream of said contact;

a heater for heating said intermediate image transfer belt downstream of said contact with said primary image transfer belt; and a final transfer station to transfer said toner image from said intermediate image transfer belt to a substrate.

10. The printer of claim 9, wherein said primary image transfer belt and said intermediate image transfer belt are in nip contact so as to minimize heat transfer from said intermediate image transfer belt to said primary image transfer belt.

11. A method of printing a single-pass multi-color image, comprising the steps of:

forming a multiple toner image on a primary image transfer belt;

transferring said toner image from said primary image transfer belt to an intermediate image transfer belt through a nip contact between said primary image transfer belt and said intermediate image transfer belt;

cooling said primary image transfer belt downstream of said nip contact;

heating said intermediate image transfer belt downstream of said nip contact with said primary image transfer belt; and transferring said toner image from said intermediate image transfer belt to a substrate.

12. The method of claim 11, further comprising the step of driving said primary and intermediate image transfer belts with separate drive motors.

13. The method of claim 11, wherein said transferring is performed across a temperature gradient.

14. The method of claim 13, wherein the temperature of said intermediate image transfer belt immediately upstream of said nip contact is at least 30 Centigrade degrees higher than the temperature of said primary image, transfer belt immediately upstream of said nip contact.

15. The method of claim 13, wherein said step of transferring is performed without active cooling of said intermediate image transfer belt.

16. In a printer, a method of minimizing heat transfer between a primary image transfer belt and an intermediate image transfer belt comprising:

forming a nip contact between said image transfer belts such that image transfer is accomplished across a temperature gradient without excessive heat transfer from said intermediate transfer belt to said primary image transfer belt;

cooling said primary image transfer belt downstream of said nip contact; and heating said intermediate image transfer belt downstream of said nip contact with said primary image transfer belt.

17. A single-pass multi-color printer comprising:

a plurality of image-forming stations at which developed toner images are formed;

a plurality of first transfer stations comprising an electrostatic transfer devices to transfer said images in register with each other from said image-forming stations to an endless primary transfer belt to form a multiple toner image thereon;

a first drive device for driving said primary transfer belt;

an intermediate transfer nip between said primary transfer belt and an endless intermediate transfer belt, said intermediate transfer nip being formed between first and second guide rollers pressed towards each other to cause tangential contact between said primary transfer belt and said intermediate transfer belt;

a device for biasing said first guide roller to create an electrical field at said intermediate transfer nip to assist in transferring said multiple toner image from said primary transfer belt to said intermediate transfer belt;

a second drive device for driving said intermediate transfer belt;

a cooler positioned to cool said primary transfer belt downstream of said intermediate transfer nip;

a heating device for heating said intermediate transfer belt downstream of said intermediate transfer nip to heat said multiple toner image thereon and to establish a temperature gradient at said intermediate transfer nip; and a final transfer station to transfer said heated multiple toner image from said intermediate transfer belt to a substrate.

18. A method of single-pass printing comprising:

forming a plurality of developed toner images at a plurality of image-forming stations;

electrostatically transferring said images at a plurality of first transfer stations in register with each other from said image-forming stations to an endless primary transfer belt to form a multiple toner image thereon;

driving said primary transfer belt to an intermediate transfer nip between said primary transfer belt and an endless intermediate transfer belt, said intermediate transfer nip being formed between first and second guide rollers pressed towards each other to cause tangential contact between said primary transfer belt and said intermediate transfer belt;

biasing said first guide roller to create an electrical field at said intermediate transfer nip to assist in transferring said multiple toner image from said primary transfer belt to said intermediate transfer belt;

driving said intermediate transfer belt;

cooling said primary transfer belt downstream of said intermediate transfer nip;

heating said intermediate transfer belt downstream of said intermediate transfer nip to heat said multiple toner image thereon and to establish a temperature gradient at said intermediate transfer nip; and transferring said heated multiple toner image from said intermediate transfer belt to a substrate at a final transfer nip.

* * * * *